US008973679B2

(12) United States Patent
Dewey et al.

(10) Patent No.: US 8,973,679 B2
(45) Date of Patent: Mar. 10, 2015

(54) INTEGRATED REAMING AND MEASUREMENT SYSTEM AND RELATED METHODS OF USE

(75) Inventors: Charles Dewey, Houston, TX (US); Simon Mitchell, Houston, TX (US)

(73) Assignee: Smith International, Inc., Houston, TX (US)

( * ) Notice: Subject to any disclaimer, the term of this patent is extended or adjusted under 35 U.S.C. 154(b) by 670 days.

(21) Appl. No.: 13/033,280

(22) Filed: Feb. 23, 2011

(65) Prior Publication Data

US 2012/0211280 A1 Aug. 23, 2012

(51) Int. Cl.
*E21B 7/28* (2006.01)
*E21B 10/32* (2006.01)
*E21B 47/08* (2012.01)

(52) U.S. Cl.
CPC ..... *E21B 10/322* (2013.01); *E21B 47/08* (2013.01)
USPC ..... 175/265; 175/57

(58) Field of Classification Search
CPC ..... E21B 10/322; E21B 10/32; E21B 7/28; E21B 17/01078; E21B 47/00
USPC ..... 175/57, 265, 269, 263, 391
See application file for complete search history.

(56) References Cited

U.S. PATENT DOCUMENTS 5,318,138 A * 6/1994 Dewey et al. ..... 175/74
5,332,048 A * 7/1994 Underwood et al. ..... 175/26
6,732,817 B2 5/2004 Dewey et al.
6,848,518 B2 * 2/2005 Chen et al. ..... 175/61
7,048,078 B2 * 5/2006 Dewey et al. ..... 175/57
7,314,099 B2 * 1/2008 Dewey et al. ..... 175/57
7,506,703 B2 * 3/2009 Campbell et al. ..... 175/265
7,506,787 B2 3/2009 Wu et al.
7,513,318 B2 * 4/2009 Underwood et al. ..... 175/61
7,600,420 B2 * 10/2009 Meek ..... 73/152.54
7,699,120 B2 4/2010 Desai
7,757,787 B2 * 7/2010 Mackay et al. ..... 175/269
8,061,451 B2 * 11/2011 Salzer et al. ..... 175/325.3
8,235,144 B2 * 8/2012 Rasheed ..... 175/57
8,528,668 B2 * 9/2013 Rasheed ..... 175/384
2005/0126825 A1 6/2005 Moriarty et al.
2006/0207797 A1 * 9/2006 Dewey et al. ..... 175/57
2006/0249307 A1 11/2006 Ritter et al.
2008/0245574 A1 * 10/2008 Campbell et al. ..... 175/57

(Continued)

FOREIGN PATENT DOCUMENTS

GB 2460096 A 11/2009

OTHER PUBLICATIONS

Observation by a third party issued in corresponding European Application No. 12750076.7 dated Sep. 19, 2013 (19 pages).

(Continued)

*Primary Examiner* — Kenneth L Thompson
*Assistant Examiner* — Michael Wills, III
(74) *Attorney, Agent, or Firm* — Osha Liang LLP

(57) ABSTRACT

A downhole reaming system includes a tubular body having a drill bit disposed on a distal end thereof, and a central bore therethrough, wherein the tubular body is attached to a drillstring, an expandable reamer having cutter blocks coupled thereto and configured to selectively expand radially therefrom, a near-bit reamer disposed proximate the drill bit, the near-bit reamer having cutter blocks coupled thereto and configured to expand therefrom, and a measurement sub configured to measure at least one characteristic of an interior wall of an enlarged wellbore.

18 Claims, 3 Drawing Sheets

(56) References Cited

U.S. PATENT DOCUMENTS

| | | | | |
|---|---|---|---|---|
| 2009/0145666 | A1* | 6/2009 | Radford et al. | 175/269 |
| 2009/0190850 | A1* | 7/2009 | Tang | 382/251 |
| 2009/0242275 | A1* | 10/2009 | Radford et al. | 175/57 |
| 2009/0294178 | A1* | 12/2009 | Radford | 175/57 |
| 2010/0006338 | A1* | 1/2010 | Desai | 175/27 |
| 2010/0006339 | A1 | 1/2010 | Desai | |
| 2010/0089583 | A1* | 4/2010 | Xu et al. | 166/298 |
| 2010/0097890 | A1 | 4/2010 | Sullivan et al. | |
| 2010/0108386 | A1* | 5/2010 | Martinez et al. | 175/45 |
| 2012/0055711 | A1* | 3/2012 | Brannigan et al. | 175/50 |

OTHER PUBLICATIONS

International Search Report and Written Opinion of PCT Application No. PCT/US2012/026354 (10SBE124WO) dated Aug. 7, 2012: pp. 1-11.

* cited by examiner

INTEGRATED REAMING AND MEASUREMENT SYSTEM AND RELATED METHODS OF USE

BACKGROUND

1. Field of the Disclosure

Embodiments disclosed herein relate generally to downhole tools. In particular, embodiments disclosed herein relate to expandable underreamers and related methods of use.

2. Background Art

In the drilling of oil and gas wells, typically concentric casing strings are installed and cemented in the wellbore as drilling progresses to increasing depths. Each new casing string is supported within the previously installed casing string, thereby limiting the annular area available for the cementing operation. Further, as successively smaller diameter casing strings are suspended, the flow area for the production of oil and gas is reduced. Therefore, to increase the annular space for the cementing operation, and to increase the production flow area, it is often desirable to enlarge the wellbore below the terminal end of the previously cased wellbore. By enlarging the wellbore, a larger annular area is provided for subsequently installing and cementing a larger casing string than would have been possible otherwise. Accordingly, by enlarging the wellbore below the previously cased wellbore, the bottom of the formation can be reached with comparatively larger diameter casing, thereby providing more flow area for the production of oil and gas.

Various methods have been devised for passing a drilling assembly through a cased wellbore, or in conjunction with expandable casing to enlarge the wellbore. One such method involves the use of an underreamer, which has basically two operative states—a closed or collapsed state, where the diameter of the tool is sufficiently small to allow the tool to pass through the existing cased wellbore, and an open or partly expanded state, where one or more arms with cutters on the ends thereof extend from the body of the tool. In this latter position, the underreamer enlarges the wellbore diameter as the tool is rotated and lowered in the wellbore.

Because the underreamer may be positioned a distance uphole from a drill bit on a distal end of the drillstring, an un-reamed portion of the wellbore, often referred to in the industry as the rat hole, may exist between the underreamer and the drill bit after the borehole is enlarged. In certain instances, the distance may be up to 125 feet or more. To underream the rat hole, the first underreamer is often removed from the wellbore and replaced with a second underreamer, requiring multiple trips into the wellbore.

Accordingly, there exists a need for an integrated reamer system capable of fully underreaming a wellbore and providing measurement data of the enlarged wellbore.

SUMMARY OF THE DISCLOSURE

In one aspect, embodiments disclosed herein relate to a downhole reaming system including a tubular body having a drill bit disposed on a distal end thereof, and a central bore therethrough, wherein the tubular body is attached to a drillstring, an expandable reamer having cutter blocks coupled thereto and configured to selectively expand radially therefrom, a near-bit reamer disposed proximate the drill bit, the near-bit reamer having cutter blocks coupled thereto and configured to expand therefrom, and a measurement sub configured to measure at least one characteristic of an interior wall of an enlarged wellbore.

In other aspects, embodiments disclosed herein relate to a method of enlarging a wellbore including running a drillstring having a tubular body attached thereto into a wellbore the tubular body comprising an expandable reamer, a drill bit disposed on a distal end of the tubular body, and a near-bit reamer located proximate the drill bit, expanding cutter blocks of the expandable reamer and enlarging a portion of the wellbore, and measuring and recording at least one characteristic of an interior wall of the enlarged portion of the wellbore. The method further includes expanding cutter blocks of the near-bit reamer and enlarging a portion of the wellbore defined between the expandable reamer and the drill bit, wherein enlarging the portion of the wellbore and measuring and recording the at least one characteristic of the interior wall of the enlarged portion of the wellbore occur in the same trip into the wellbore.

Other aspects and advantages of the invention will be apparent from the following description and the appended claims.

DETAILED DESCRIPTION

Figure 1:
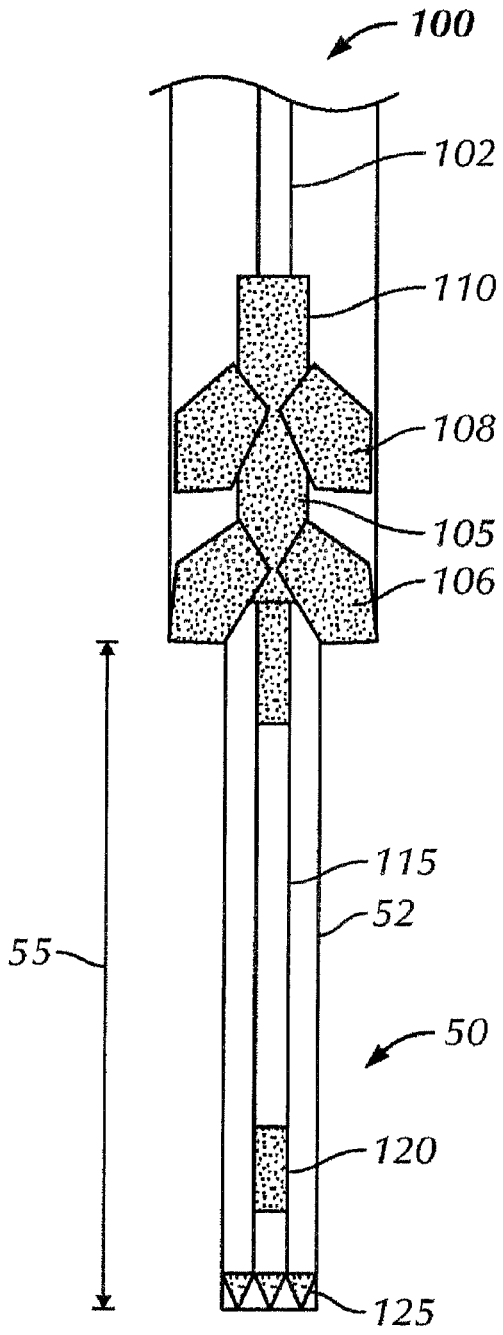
FIG. 1 shows a plan view of an integrated reamer and measurement tool in accordance with one or more embodiments of the present disclosure.

In one aspect, embodiments disclosed herein relate to an integrated reamer and measurement tool capable of enlarging a wellbore and measuring the enlarged wellbore in a single trip into the wellbore. As used herein, a "trip" is when the entire drillstring is removed from the well to, for example, replace equipment in the drillstring. Referring initially to FIG. 1, a plan view of an integrated reamer and measurement tool 100 in accordance with one or more embodiments of the present disclosure is shown. The integrated reamer and measurement tool 100 is attached to a drillstring 102 and includes a selectively expandable reamer 105 having primary cutter blocks 106 coupled with the tool body 100 and located at an axial distance (up to 200 feet) from a drill bit 125 disposed on a distal end thereof. The drill bit 125 may be a roller cone bit or a fixed cutter bit as determined by one of ordinary skill in the art. The integrated tool 100 further includes a selectively expandable near-bit reamer 120 located proximate the drill bit 125 disposed on a distal end thereof and a measurement sub 110 located proximate the expandable reamer 105, both of which will be described in detail later.

Figure 2:
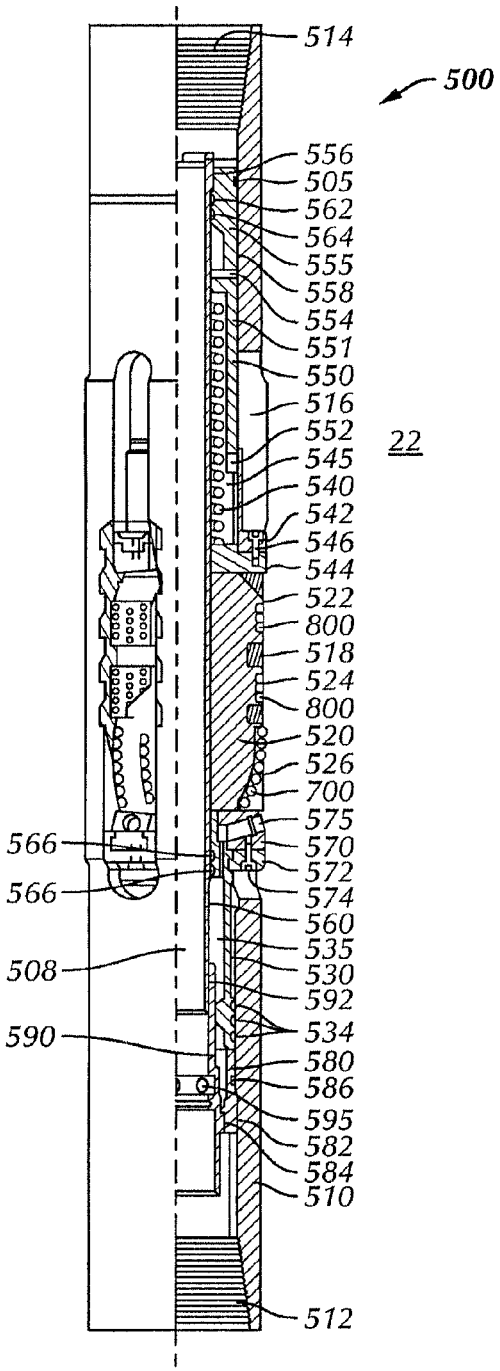
FIGS. 2 and 3 show cross-section views of a first expandable reamer in collapsed and expanded positions in accordance with one or more embodiments of the present disclosure.
Figure 3:
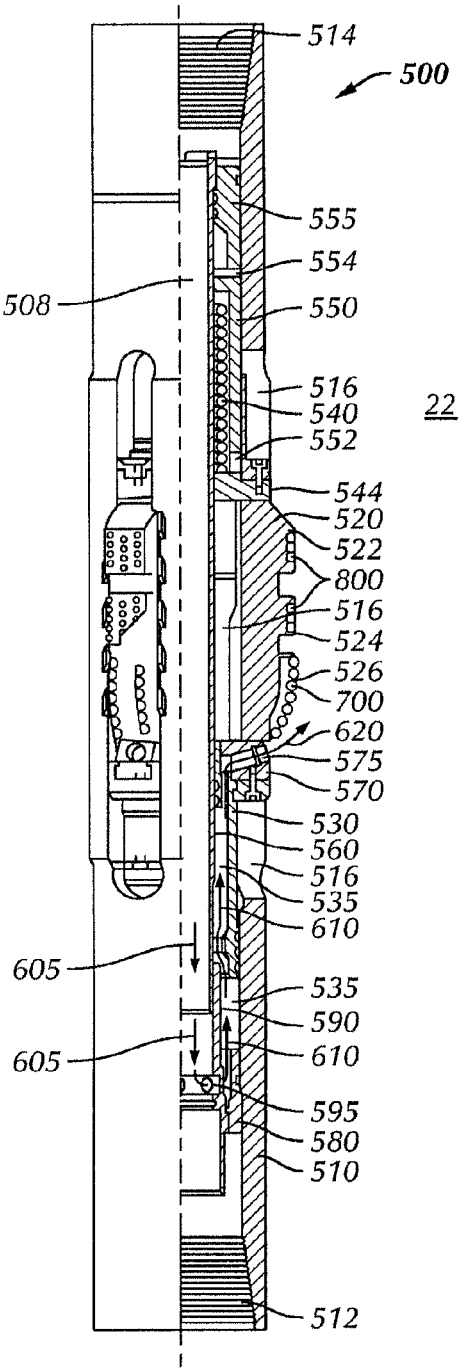

Referring briefly to FIGS. 2 and 3, cross-section views of the expandable reamer 105 in a collapsed position (FIG. 2) and an expanded position (FIG. 3) in accordance with one or more embodiments of the present disclosure are shown. The expandable reamer 105 includes a generally cylindrical tool body 510 with a flowbore 508 extending therethrough. The tool body 510 includes upper 514 and lower 512 connection portions for connecting the tool 500 into a drilling assembly. In approximately the axial center of the tool body 510, one or more pocket recesses 516 are formed in the body 510 and spaced apart azimuthally around the circumference of the body 510. The one or more recesses 516 accommodate the axial movement of several components of the tool 500 that move up or down within the pocket recesses 516, including one or more movable, non-pivotable, tool arms 520. Each recess 516 stores one movable arm 520 in the collapsed position. In certain embodiments, the expandable reamer 500 includes three movable arms 520 disposed within three pocket recesses 516.

The recesses 516 further include angled channels 518 that provide a drive mechanism for the movable tool arms 520 to move axially upwardly and radially outwardly into the expanded position shown in FIG. 3. A biasing spring 540 may be included to bias the arms 520 to the collapsed position of FIG. 2. The biasing spring 540 is disposed within a spring cavity 545 and covered by a spring retainer 550. Retainer 550 is locked in position by an upper cap 555. A stop ring 544 is provided at the lower end of the spring 540 to keep the spring 540 in position.

Below movable arms 520, a drive ring 570 is provided that includes one or more nozzles 575. An actuating piston 530 that forms a piston cavity 535, engages the drive ring 570. A drive ring block 572 connects the piston 530 to the drive ring 570 via bolt 574. The piston 530 is adapted to move axially in the pocket recesses 516. A lower cap 580 provides a lower stop for the axial movement of the piston 530. An inner mandrel 560 is the innermost component within the tool 500, and it slidingly engages a lower retainer 590 at 592. The lower retainer 590 includes ports 595 that allow drilling fluid to flow from the flowbore 508 into the piston chamber 535 to actuate the piston 530.

The movable arms 520 include pads 522, 524, and 526 with structures 700, 800 that engage the wellbore when the arms 520 are expanded outwardly to the expanded position of the tool 500 shown in FIG. 3. Below the arms 520, the piston 530 sealingly engages the inner mandrel 560 at 566, and sealingly engages the body 510 at 534. The lower cap 580 is threadingly connected to the body and to the lower retainer 590 at 582, 584, respectively. A sealing engagement is also provided at 586 between the lower cap 580 and the body 510. The lower cap 580 provides a stop for the piston 530 to control the collapsed diameter of the tool 500.

Several components are provided for assembly rather than for functional purposes. For example, drive ring 570 is coupled to the piston 530, and then the drive ring block 572 is boltingly connected at 574 to prevent the drive ring 570 and the piston 530 from translating axially relative to one another. The drive ring block 572, therefore, provides a locking connection between the drive ring 570 and the piston 530.

FIG. 3 depicts the tool 500 with the movable arms 520 in the maximum expanded position, extending radially outwardly from the body 510. Once the tool 500 is in the wellbore, it is only expandable to one position. Therefore, the tool 500 has two operational positions—namely a collapsed position as shown in FIG. 2 or an expanded position shown in FIG. 3. However, the spring retainer 550, which is a threaded sleeve, may be adjusted at the surface to limit the full diameter expansion of arms 520. The spring retainer 550 compresses the biasing spring 540 when the tool 500 is collapsed, and the position of the spring retainer 550 determines the amount of expansion of the arms 520. The spring retainer 550 is adjusted by a wrench in the wrench slot 554 that rotates the spring retainer 550 axially downwardly or upwardly with respect to the body 510 at threads 551. The upper cap 555 is also a threaded component that locks the spring retainer 550 once it has been positioned.

In the expanded position shown in FIG. 3, the arms 520 will either underream the wellbore or stabilize the drilling assembly, depending upon how pads 522, 524, and 526 are configured. In the configuration shown in FIG. 3, cutting structures 700 on pads 526 would underream the wellbore. Wear buttons 800 on pads 522 and 524 would provide gauge protection as the underreaming progresses. Hydraulic force causes the arms 520 to expand outwardly to the position shown in FIG. 3 due to differential pressure of the drilling fluid between the flowbore 508 and the annulus 22.

The drilling fluid flow along path 605, through ports 595 in the lower retainer 590, along path 610 into the piston chamber 535. The differential pressure between the fluid in the flowbore 508 and the fluid in the wellbore annulus 22 surrounding tool 500 causes the piston 530 to move axially upwardly from the position shown in FIG. 2 to the position shown in FIG. 3. A small amount of flow may move through the piston chamber 535 and through nozzles 575 to the annulus 22 as the tool 500 starts to expand. As the piston 530 moves axially upwardly in pocket recesses 516, the piston 530 engages the drive ring 570, thereby causing the drive ring 570 to move axially upwardly against the movable arms 520. The arms 520 will move axially upwardly in pocket recesses 516 and also radially outwardly as the arms 520 travel in channels 518 disposed in the body 510. In the expanded position, the flow continues along paths 605, 610 and out into the annulus 22 through nozzles 575. Because the nozzles 575 are part of the drive ring 570, they move axially with the arms 520. Accordingly, these nozzles 575 are optimally positioned to continuously provide cleaning and cooling to the cutting structures 700 disposed on surface 526 as fluid exits to the annulus 22 along flow path 620.

In certain embodiments, the tool 500 is capable of providing a hydraulic indication at the surface, thereby informing the operator whether the tool is in the contracted position shown in FIG. 2 or the expanded position shown in FIG. 3. Namely, in the contracted position, the flow area within piston chamber 535 is smaller than flow area within piston chamber 535 when the tool 500 is in the expanded position shown in FIG. 3. Therefore, in the expanded position, the flow area in chamber 535 is larger, providing a greater flow area between the flowbore 508 and the wellbore annulus 22. In response, pressure at the surface will decrease as compared to the pressure at the surface when the tool 500 is contracted. This decrease in pressure indicates that the tool 500 is expanded. Additional description of the expandable reamer 500 described herein may be found in U.S. Pat. No. 6,732,817, assigned to the assignee of the present invention, and hereby incorporated by reference in its entirety. In certain embodiments, the tool 500 may include an actuation system as described in U.S. Pat. No. 7,699,120, entitled "On Demand Actuation System" and assigned to the present assignee and incorporated by reference herein in its entirety. Likewise, in other embodiments, the tool 500 may include an actuation system as described in U.S. Patent Publication No. 2010/0006338, entitled "Optimized Reaming System Based Upon Weight on Tool" and assigned to the present assignee and incorporated by reference herein in its entirety.

Figure 4:
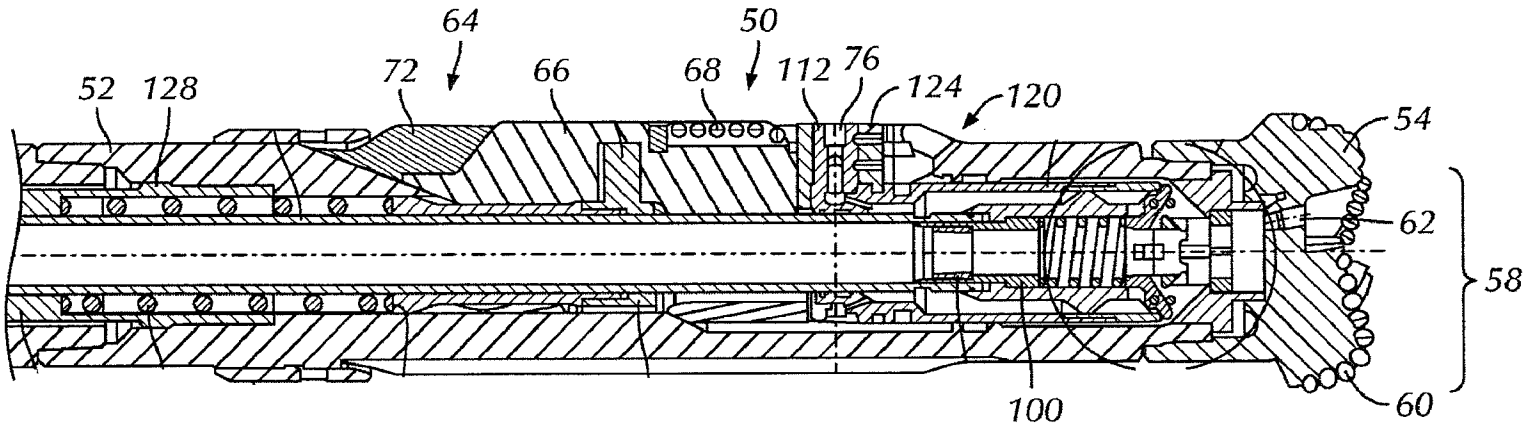
FIG. 4 shows a cross-section view of a near bit reamer in accordance with one or more embodiments of the present disclosure.

Referring back to FIG. 1, and as previously described, the integrated reamer and measurement tool 100 further includes a selectively expandable near-bit reamer 120 located proximate the drill bit 125 disposed on a distal end thereof. As used herein, proximate may be defined as the near-bit underreamer being located substantially near the drill bit. The near-bit underreamer 120 may, for example, be configured as shown in FIG. 4 in accordance with one or more embodiments of the present disclosure. Referring to FIG. 4, drilling assembly 50 is shown having a cutting head 54 located at a distal end of a substantially tubular main body 52, the body 52 connected to a drillstring (not shown). It should be understood that the term "drillstring" may be used to describe any apparatus or assembly that may be used to thrust and rotate drilling assembly 50. Particularly, the drillstring may include mud motors, bent subs, rotary steerable systems, drill pipe rotated from the surface, coiled tubing or any other drilling mechanism known to one of ordinary skill. Furthermore, it should be understood that the drillstring may include additional components (e.g., MWD/LWD tools, stabilizers (e.g., expandable and hydraulic), and weighted drill collars, etc.) as needed to perform various downhole tasks.

Cutting head 54 is depicted with a cutting structure 58 including a plurality of polycrystalline diamond compact ("PDC") cutters 60 and fluid nozzles 62. While drilling assembly 50 depicts a PDC cutting head 54, it should be understood that any cutting assembly known to one of ordinary skill in the art, including, but not limited to, roller-cone bits and impregnated natural diamond bits, may be used. As drilling assembly 50 is rotated and thrust into the formation, cutters 60 scrape and gouge away at the formation while fluid nozzles 62 cool, lubricate, and wash cuttings away from cutting structure 58. Tubular main body 52 includes a plurality of axial recesses 64 into which arm assemblies 66 are located. Arm assemblies 66 are configured to extend from a retracted (shown) position to an extended position (FIG. 3) when cutting elements 68 and stabilizer pads 70 of arm assemblies are to be engaged with the formation.

Arm assemblies 66 travel from their retracted position to their extended position along a plurality of grooves 72 within the wall of axial recesses 64. Corresponding grooves along the outer profile of arm assemblies 66 engage grooves 72 and guide arm assemblies 66 as they traverse in and out of axial recesses 64. While three arm assemblies 66 are depicted in figures of the present disclosure, it should be understood that any number of arm assemblies 66 may be employed, from a single arm assembly 66 to as many arm assemblies 66 as the size and geometry of main body 52 may accommodate. Furthermore, while each arm assembly 66 is depicted with both stabilizer pads 70 and cutting elements 68, it should be understood that arm assemblies 66 may include stabilizer pads 70, cutting elements 68, or a combination thereof in any proportion appropriate for the type of operation to be performed. Additionally, arm assembly 66 may include various sensors, measurement devices, or any other type of equipment desirably retractable and extendable from and against the wellbore upon demand.

In operation, cutting structure 58 is designed and sized to cut a pilot bore, or a bore that is large enough to allow drilling assembly 50 in its retracted (FIG. 1) state and remaining components of the drillstring to pass therethrough. In circumstances where the wellbore is to be extended below a string of casing, the geometry and size of cutting structure 58 and main body 52 is such that entire drilling assembly 50 may pass clear of the casing string without becoming stuck. Once clear of the casing string or when a larger diameter wellbore is desired, arm assemblies 66 are extended and cutting elements 68 disposed thereupon (in conjunction with stabilizer pads 70) underream the pilot bore to the final gauge diameter.

Preferably, drilling assembly 50 uses hydraulic energy to extend arm assemblies 66 from and into axial recesses 64 within main body 52. Drilling fluid is a necessary component of virtually all drilling operations and is delivered downhole from the surface at elevated pressures through a bore of the drillstring. Similarly, drilling assembly 50 includes a through bore 74, through which drilling fluids flow through drillstring connection 56 and main body 52 and out fluid nozzles 62 of cutting head 54 to lubricate cutters 60. As with other downhole drilling devices, the fluid exiting the bore at the bottom of the drillstring returns to the surface along an annulus formed between the wellbore and the outer profile of the drillstring and any tools attached thereto.

Because of flow restrictions and differential areas between the bore and the annulus of drillstring components, the annulus return pressure is typically significantly lower than the bore supply pressure. This differential pressure between the bore and annulus is referred to as the pressure drop across the drillstring. Therefore, for every drillstring configuration, a characteristic pressure drop exists that may be measured and monitored at the surface. As such, if leaks in drill pipe connections, changes in the drillstring flowpath, or clogs within fluid pathways emerge, an operator monitoring the drillstring pressure drop from the surface will notice a change and may take action if necessary.

Similarly, drilling assembly 50 will desirably exhibit characteristic pressure drop profiles at various stages of operation downhole. When drilling with arm assemblies 66 in their retracted state within axial recesses 64, drilling assembly 50 will exhibit a pressure drop profile corresponding to that retracted state. When the operator desires to extend arm assemblies 66, the pressure and/or flow rate of drilling fluids flowing through bore 74 are increased to exceed a predetermined activation level. Once the activation level is exceeded, a flow switch activates a mechanism that will extend arm assemblies 66. Following such activation, a portion of the drilling fluids are diverted from through bore 74 of main body 52 to the annulus through a plurality of nozzles 76 located adjacent to axial recesses 64. As drilling fluids begin flowing through nozzles 76, the characteristic pressure drop of drilling assembly 50 changes to an intermediate profile such that the operator at the surface is aware the flow switch is activated and underreaming has begun. Once arm assemblies 66 are fully extended, drilling assembly 50 is desirably constructed such that additional flow through an indication nozzle (77 of FIG. 3) results and another pressure drop profile corresponding to the extended state is exhibited. When the drilling assembly 50 exhibits the expanded characteristic pressure drop profile, an operator monitoring at the surface is aware that arm assemblies 66 have fully extended. Additionally, it is desirable that the intermediate pressure drop profile of drilling fluids remains constant throughout the extension of arm assemblies, such that the surface operator observes a step-plateau change in pressure drop profile for drilling assembly 50.

When retraction of arm assemblies 66 is desired, the operator reduces (or completely cuts off) the pressure and/or flow rate of drilling fluids through bore 74 to a level below a predetermined reset level. Once decreased to the reset level, internal biasing mechanisms retract arm assemblies 66 and shut off flow between bore 74 and nozzles 76 and 77. Alternatively, the flow of drilling fluids through bore 74 can be cut off altogether. Following retraction, flow through nozzles 76 is halted and the operator may again observe the characteristic pressure drop profile associated with the retracted state across drilling assembly 50 and know that arm assemblies 66 are fully retracted. As with the extension process, an intermediate pressure drop profile will be observed while arm assemblies 66 are in the process of retracting, but not fully retracted. Once the operator observes the "retracted" characteristic pressure drop, they may proceed to raise the pressure and/or flow rate of drilling fluids through drilling assembly 50 up to the activation level without concern for extending arm assemblies 66. Additional description of the near-bit underreamer 120 described herein may be found in U.S. Pat. No. 7,506,703, assigned to the assignee of the present invention, and hereby incorporated by reference in its entirety.

Referring again back to FIG. 1, the integrated reamer and measurement tool 100 further includes a measurement sub 110 located proximate the expandable reamer 105, the measurement sub 110 configured to measure various properties and/or characteristics of an interior wall of the wellbore. The integrated tool 100 further includes a bottomhole assembly 115 that may include measurement-while-drilling or logging-while-drilling equipment. In general, "logging-while-drilling" ("LWD") refers to measurements related to the formation and its contents. "Measurement-while-drilling" ("MWD"), on the other hand, refers to measurements related to the borehole and the drill bit. The distinction is not germane to the present invention, and any reference to one should not be interpreted to exclude the other.

LWD sensors located in measurement sub 110 may include, for example, one or more of a gamma ray tool, a resistivity tool, an NMR tool, a sonic tool, a formation sampling tool, a neutron tool, and electrical tools. Such tools are used to measure properties of the formation and its contents, such as, the formation porosity, density, lithology, dielectric constant, formation layer interfaces, as well as the type, pressure, and permeability of the fluid in the formation.

One or more MWD sensors may also be located in measurement sub 110. MWD sensors may measure the loads acting on the drill string, such as WOB, TOB, and bending moments. It is also desirable to measure the axial, lateral, and torsional vibrations in the drill string. Other MWD sensors may measure the azimuth and inclination of the drill bit, the temperature and pressure of the fluids in the borehole, as well as properties of the drill bit such as bearing temperature and grease pressure.

The data collected by LWD/MWD tools is often relayed to the surface before being used. In some cases, the data is simply stored in a memory in the tool and retrieved when the tool it brought back to the surface. Any database for storing data may be used. For example, any commercially available database may be used. In addition, a database may be developed for the particular purpose of storing drilling data. In one embodiment, the remote data store uses a WITSML (Wellsite Information Transfer Standard) data transfer standard. Other transfer standards may also be used in accordance with embodiments disclosed herein.

In other cases, LWD/MWD data may be transmitted to the surface using known telemetry methods. The measurement equipment of the measurement sub 110 may be configured to measure and record dimensions of the enlarged wellbore, which may be transmitted to an operator on the surface through an umbilical or other type of data connection (not shown). The data connection may be capable of real-time communication such that data may be transmitted instantaneously. "Real-time" pertains to a data-processing system that controls an ongoing process and delivers its outputs (or controls its inputs) not later than the time when these are needed for effective control. In this disclosure, "in real-time" means that optimized drilling parameters for an upcoming segment of formation to be drilled are determined and returned to a data store at a time not later than when the drill bit drills that segment. The information is available when it is needed. This enables a driller or automated drilling system to control the drilling process in accordance with the optimized parameters. Thus, "real-time" is not intended to require that the process is "instantaneous."

In certain embodiments, the measurement sub 110 may include one or more devices 108 for measuring parameters related to the shape of the interior wall of the wellbore, more commonly called "calipers." Caliper apparatus and methods generally include sensors disposed in or on components that are configured to be coupled into a drillstring. It may be desirable to have information concerning the shape of the wellbore wall, for example, for calculating cement volume necessary to cement a pipe of casing in the wellbore. It may also be desirable to know the distance between certain types of sensors and the wall of the wellbore, for example, acoustic, neutron and density sensors. Caliper devices known in the art for use in drill strings include acoustic travel time based devices. An acoustic transducer emits an ultrasonic pulse into the drilling fluid in the wellbore, and a travel time to the wellbore wall back to the transducer of the acoustic pulse is used to infer the distance from the transducer to the wellbore wall. In one embodiment, a drillstring caliper may include a tubular body configured to be coupled within a drillstring. At least one laterally extensible arm is housed in the tubular body. A biasing device may be configured to urge the at least one arm into contact with a wall of a wellbore. A sensor may be configured to generate an output signal corresponding to a lateral extent of the at least one arm.

A method for measuring an internal size of a wellbore according to certain aspects of the present disclosure includes moving a drill string through a wellbore drilled through subsurface formations. At least one contact arm extending laterally from the drill string is urged into contact with a wall of the wellbore. An amount of lateral extension of the arm is translated into corresponding movement of a sensor to generate a signal corresponding to the amount of lateral extension. The method may include at least one of communicating the signal to the Earth's surface and recording the signal in a storage device associated with the drill string.

In some instances it may be desirable to cause the arms of the caliper to contact the wellbore wall only at certain times or under certain conditions. In such case an actuator may be operable by command from the surface to open or close the caliper upon detection of such command. An example control system may be used to operate the caliper according to different drill string configurations and drilling conditions. The sensor or a plurality of such sensors may be in signal communication with a controller such as a programmable general purpose microprocessor or an application specific integrated circuit. The controller may communicate signals from the sensor to a data storage device, such as a hard drive or solid state memory disposed in the tubular body. The controller may be in signal communication with the telemetry communication channel of wired drill pipe, if such is used as the pipe string or the mud flow modulator for communication of selected signals to the recording unit.

In another embodiment, one, two and four caliper arms, typically circumferentially spaced evenly from each other when more than one caliper arm may be used. It should be understood by those skilled in the art that any number of caliper arms structure may be used in accordance with embodiments disclosed herein. The caliper has also been described as being arranged to place the arm(s) in contact with a wall of the wellbore.

Methods related to using the integrated measurement and reamer tool described in accordance with one or more embodiments herein include enlarging a main or deviated wellbore with the primary blocks of the expandable reamer. At the same time, the measurement sub located just above the expandable reamer may activate a number of transducers, which measure the expanded diameter of the enlarged wellbore and stores the data on a memory chip or other storage device and/or communicates the data to the surface. The stored data may be downloaded on a laptop or other user interface on the surface (rig) to confirm the enlarged diameter of the wellbore. In alternate embodiments, the measured data may be transmitted immediately in real-time from the measurement sub to a laptop to confirm the enlarged wellbore.

Additionally, when the reaming interval of the wellbore is completed, the tool may be pulled up sufficiently so that the near-bit reamer is positioned at the end of the enlarged bore (i.e., just above the rat hole indicated by 55 in FIG. 1). The near-bit reamer is then activated to open and reaming begins until the previously drilled depth is reached, thus enlarging the rat hole similar to the previously reamed interval. Alternatively, when the reaming interval of the wellbore is completed, the near-bit reamer may be activated to open and the tool may be pulled up such that the rat hole is enlarged. In this manner, the rat hole is also enlarged in the same trip as the rest of the wellbore.

Advantageously, embodiments of the present disclosure for an integrated measurement and reamer tool allow an operator to achieve a number of goals in a single trip into the wellbore. First, the main bore may be enlarged, next a diameter of the enlarged bore may be confirmed, and finally, the rat hole may be enlarged. The ability to complete a number of different operations in a single trip reduces drilling and rig costs and drilling time and increases productivity and efficiency.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A downhole reaming system comprising:

a drill bit disposed on a distal end of a drillstring;

an expandable reamer having cutter blocks coupled thereto and configured to selectively expand radially therefrom, positioned on the drillstring at an axial distance from the drill bit;

a near-bit reamer disposed on the drillstring proximate the drill bit, the near-bit reamer having cutter blocks coupled thereto and configured to selectively expand therefrom;

a first measurement sub disposed on the drillstring above the expandable reamer, the first measurement sub having at least one extendable arm and configured to measure at least one characteristic of an interior wall of an enlarged wellbore; and a second measurement sub disposed on the drillstring proximate the near-bit reamer, between the near-bit reamer and the expandable reamer.

2. The downhole reaming system of claim 1, further comprising a data connection configured to provide communication between at least one of the first and second measurement subs and a surface workstation.

3. The downhole reaming system of claim 2, wherein the data connection is configured to provide real-time communication between at least one of the first and second measurement subs and the surface workstation.

4. The downhole reaming system of claim 1, further comprising an on-demand actuation mechanism configured to activate the expandable reamer.

5. The downhole reaming system of claim 1, further comprising an on-demand actuation mechanism configured to activate the near-bit reamer.

6. The downhole reaming system of claim 1, wherein the expandable reamer is positioned on the drillstring up to 200 feet from the drill bit.

7. The downhole reaming system of claim 1, further comprising a data storage device configured to store data collected from at least one of the first and second measurement subs.

8. The downhole reaming system of claim 1, further comprising a rotary steerable system.

9. The downhole reaming system of claim 1, wherein at least one of the first and second measurement subs comprises at least one sensor configured to measure the at least one characteristic of the interior wall of the enlarged wellbore.

10. The downhole reaming system of claim 1, further comprising an expandable stabilizer on the drillstring.

11. The downhole reaming system of claim 1, further comprising measurement equipment disposed on the at least one extendable arm of the first measurement sub.

12. A method of enlarging a wellbore comprising:

running a drillstring having a measurement sub, an expandable reamer positioned on the drillstring below the measurement sub, a drill bit disposed on a distal end of the drillstring, and a near-bit reamer located on the drillstring proximate the drill bit;

expanding cutter blocks of the expandable reamer and enlarging a portion of the wellbore;

measuring and recording at least one characteristic of an interior wall of the enlarged portion of the wellbore above the expandable reamer as the expandable reamer progresses;

pulling up the drillstring so that the near-bit reamer is positioned at an end of the enlarged wellbore after finishing enlarging the portion of the wellbore with the expandable reamer; and expanding cutter blocks of the near-bit reamer and enlarging a portion of the wellbore defined between the expandable reamer and the drill bit;

wherein enlarging the wellbore by both the expandable reamer and the near-bit reamer and measuring the at least one characteristic of an interior wall of the enlarged portion of the wellbore above the expandable reamer occur in the same trip into the wellbore.

13. The method of claim 12, further comprising providing real-time communication of measured and recorded data to a surface workstation.

14. The method of claim 12, further comprising drilling a deviated wellbore.

15. The method of claim 12, further comprising actuating the cutter blocks of the expandable reamer by manipulating a fluid flow in the drillstring.

16. The method of claim 12, further comprising selectively expanding cutter blocks of the near-bit reamer.

17. The method of claim 12, further comprising storing data comprising of the at least one characteristic of the interior wall of the enlarged wellbore.

18. The method of claim 12, further comprising extending at least one movable arm of the measurement sub radially outward toward a sidewall of the enlarged wellbore.

* * * * *